United States Patent [19]

MacPhee et al.

[11] 4,002,047

[45] Jan. 11, 1977

[54] SHEET MATERIAL DECURLING APPARATUS

[75] Inventors: John M. MacPhee, Rowayton, Conn.; Charles Robert Gasparrini, Rye, N.Y.

[73] Assignee: Baldwin-Gegenheimer Corporation, Stamford, Conn.

[22] Filed: July 7, 1975

[21] Appl. No.: 593,568

[52] U.S. Cl. ..... 72/160; 271/63; 271/183

[51] Int. Cl.[2] ..... B21D 1/00

[58] Field of Search ..... 271/63, 183; 72/54, 72/160, 168, 166, 60, 165; 29/421 R

[56] References Cited

UNITED STATES PATENTS

| | | | |
|---|---|---|---|
| 2,323,768 | 7/1943 | Hanna | 72/165 |
| 3,076,492 | 2/1963 | Monks | 72/160 X |
| 3,559,438 | 2/1971 | Rouyer et al. | 72/160 |

*Primary Examiner*—Milton S. Mehr

*Attorney, Agent, or Firm*—St.Onge Mayers Steward & Reens

[57] ABSTRACT

A sheet material decurling apparatus for use with a machine having a sheet conveyor comprises a trough member which includes two elongate, sheet supporting members, each having an arcuate upper surface with a radius greater than 250*t*, where t is the thickness of the sheet material. An elongate fillet, curved in the direction opposite to and joining the sheet supporting member surfaces, has a radius less than 15*t*. Further, the angle formed between the planes tangent to the sheet supporting member surfaces at the lines of transition therefrom into the fillet is in the range of 60° to 120°. A series of vacuum conduits are disposed in the trough member adjacent the bottom of the fillet and have a total cross-sectional area of approximately 0.07 inches square per linear foot of trough member. A vacuum pump is connected to the vacuum conduits to effect air flow downwardly through the trough member. The conveyor draws the sheet material across the trough member with the curl directed downwardly so that air flow caused by the vacuum pump can pull the sheet material down onto the sheet supporting member surfaces and into the fillet surface to impart a bend, opposite to that of the curl, to the sheet.

The trough member geometry causes effective sheet decurling without imparting additional curl to the sheet. The vacuum conduit sizing reduces the capacity of the vacuum pump needed for effective decurling while allowing operation on sheets having widths less than the decurler capacity without covering the exposed conduits.

11 Claims, 6 Drawing Figures

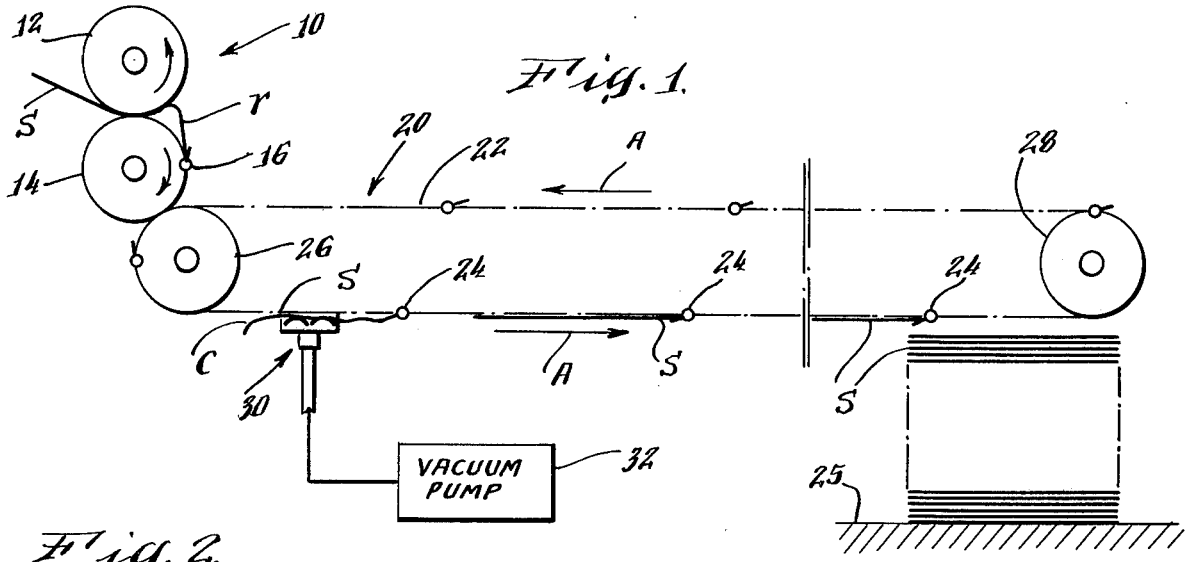
Fig. 1.
Fig. 2.
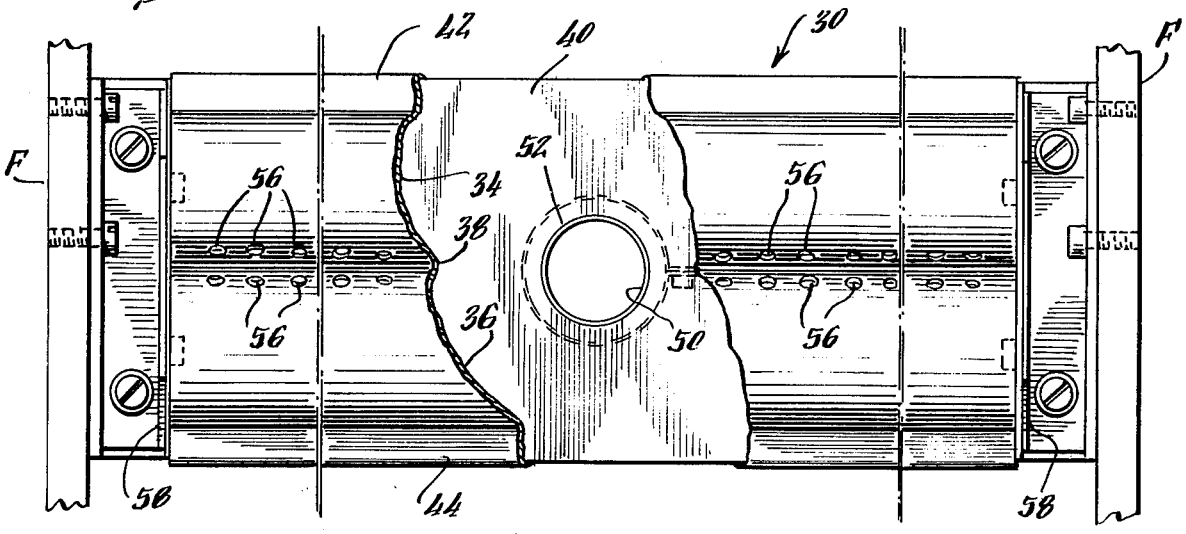
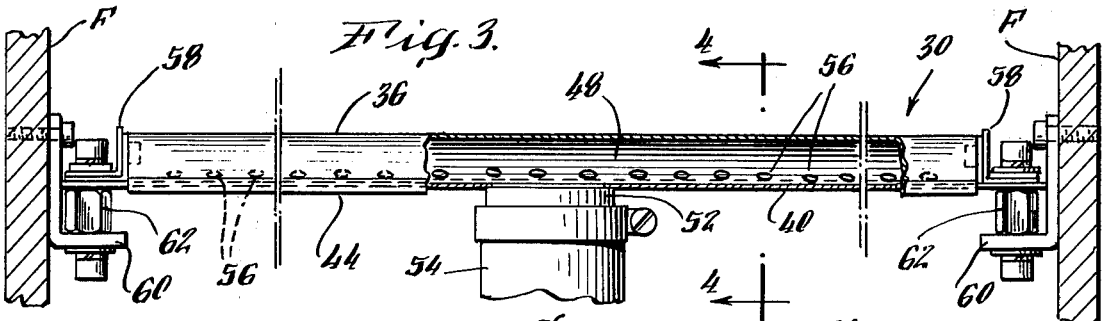
Fig. 3.
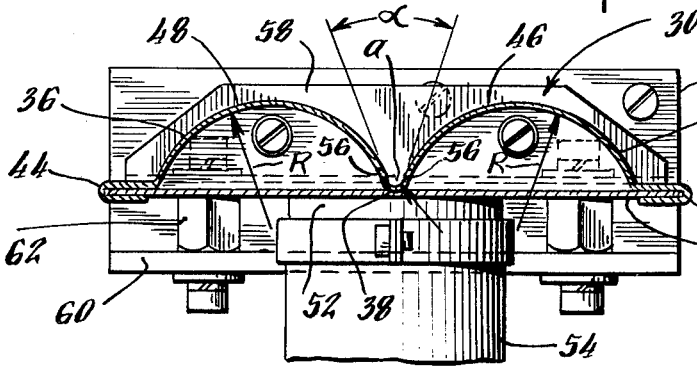
Fig. 4.

SHEET MATERIAL DECURLING APPARATUS

BACKGROUND OF THE INVENTION

1. Field of the Invention

The present invention relates to a sheet material decurling apparatus for use in machines having a sheet material conveyor, and particularly for use in printing presses.

Paper and metal foil sheet materials behave in both an elastic and a plastic manner. If deformed slightly, for example, by stretching or bending, they will return to their original shape and position when the deforming force is removed. Thus, the sheet materials exhibit elastic characteristics. However, if deformed to a much larger degree, for example, by folding, they will not return to their original shape and position when the deforming force is removed. Thus, the sheet materials exhibit plastic characteristics.

When such sheet materials are deformed beyond their elastic limit, that is when plastically deformed, for example in sheet handling machinery, they acquire a curl which makes them difficult to subsequently manipulate and stack.

Curl results from the tendency of the sheets to adhere to the inked, tacky blanket cylinder surface in certain printing presses beyond the plane tangent to both the blanket and impression cylinders of those presses. This tendency causes the sheets to be pulled from the blanket cylinder through a small radius and, thus, to be plastically deformed.

Sheet material, primarily paper, can also acquire curl from other causes such as non-uniform moisture distribution during the forming process and change in the sheet structure during the printing or finishing operation.

2. Description of the Prior Art

Various apparatus for removing a primary curl from sheet material are presently known. For example, U.S. Pat. No. 3,076,492 (Monks) discloses a sheet decurler which includes an open reverse-bending suction trough that extends transversely of the sheet. The sheet receives a reverse curvature when it is drawn into the trough by suction.

Another known, commercially available sheet decurling apparatus includes an extruded aluminum decurler bar having a trough-like shape. A slot is disposed at the vertex of the trough and is connected to a vacuum generating unit.

Prior art devices of the type generally described above have certain drawbacks, however. They are not capable of effectively decurling sheet materials which have different dimensions without certain modifications. For example, exposed portions of a vacuum conduit or slot are usually covered with adhesive tape when less than full width sheets are decurled. Further, most efficient use of the vacuum source is not achieved.

SUMMARY OF THE INVENTION

In a preferred embodiment, to be described below in detail, the apparatus of the present invention is designed to effectively remove an undesirable primary curl from sheet material without imparting additional primary or secondary reverse curl to the material. Moreover, the apparatus can do so for different sheet materials having widely varying widths by making efficient use of a vacuum pump. For example, this apparatus is capable of handling, without modification, sheets having width half as great as the apparatus capacity and any size sheet between full and half width.

The sheet decurling apparatus of the present invention comprises a trough member that includes two elongate, sheet supporting members which are mutually parallel and which have arcuate upper surfaces with a radius greater than that which would plastically deform the sheet. It has been found that if the sheet material has thickness $t$, the radius of these arcuate surfaces should be greater than $250t$ and in no case less than $100t$.

An elongate fillet joins the sheet supporting members, is curved in the direction opposite to the supporting member surfaces, and has a radius less than that which would plastically deform the sheet to a degree equal to the curl being removed. It has also been found that the fillet should have a radius less than $15t$ to insure that the curl present in the sheet material is effectively removed.

The angle formed between the planes tangent to the sheet supporting member surfaces at the lines of transition therefrom into the fillet surface is in the range of 60° to 120°.This trough member geometry facilitates effective decurling without imparting additional primary or reverse curl to the sheet.

A plurality of vacuum conduits, disposed adjacent the fillet, are connected to a vacuum pump which creates air flow downwardly therethrough. The vacuum conduits have cross-sectional area of from 0.05 square inch to 0.15 square inch per linear foot of trough member. It has been found that this sizing facilitates effective pull down of the sheet material to the trough member when the sheet is drawn across it and, further, effective decurling by pulling the sheet material into the fillet.

Moreover, the vacuum pump capacity necessary to achieve these results is much lower than that previously needed. The conduit sizing also permits decurling operation on sheets having width less than the full decurler capacity without closing off the exposed conduits. Thus, this decurling apparatus has great versatility. The vacuum pump is also adjustable for most efficient use, providing a range of pressure differentials through the vacuum conduits, so that varying degrees of sheet curl may be removed.

The vacuum pump may also be adapted to provide reversible air flow to create an air cushion for sheets drawn over the trough member should decurling not be required. This reversible feature also permits purging the vacuum system of unwanted debris.

Accordingly, it is an object of the present invention to provide an apparatus for removing curl from sheet material both effectively and efficiently over a wide range of operating conditions for various types of sheet material having varying dimensions.

Other objects, aspects, and advantages of the present invention will be pointed out in, or will be understood from, the following detailed description provided below in conjunction with the accompanying drawings.

BRIEF DESCRIPTION OF THE DRAWINGS

FIG. 1 is a diagrammatic side elevational view of a printing press and of the apparatus of the present invention.

FIG. 2 is a top plan view of the trough member, partly broken away to show detail.

FIG. 3 is a side elevational view of this trough member, also partly broken away to show detail.

FIG. 4 is a vertical cross-sectional view taken through plane 4—4 in FIG. 3 illustrating the sheet supporting surfaces and fillet in detail.

DETAILED DESCRIPTION OF THE PREFERRED EMBODIMENT

Figure 5:
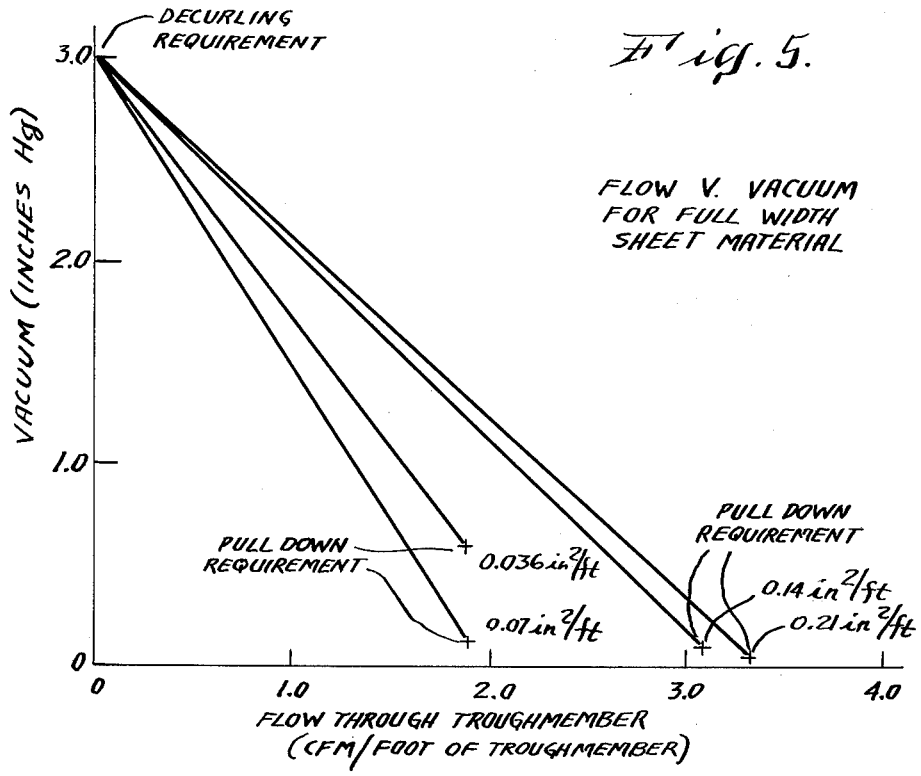
FIG. 5 is a graph of vacuum versus air flow through the trough member which illustrates pull down and decurling requirements for various vacuum conduit cross-sectional areas.

FIG. 1 diagrammatically illustrates a printing press which is equipped with the apparatus of the present invention. The press, generally indicated at 10, may be of either the direct print or off-set print type and includes a blanket cylinder 12, which receives an inked image, and an impression cylinder 14, which rotates in contact with the inked blanket cylinder surface. The impression cylinder is provided with at least one set of grippers 16 which receive the leading edge of a sheet S of material such as paper and draws the sheet into the nip of the rotating blanket and impression cylinders.

During the printing operation, the sheet may adhere to the tacky, inked surface of the blanket cylinder beyond the plane tangent to both the impression and blanket cylinders. Accordingly, the sheet may be pulled from the blanket roll through a radius *r* small enough to effect plastic deformation and, hence, curling of the sheet. Such a primary curl is indicated at C. In addition, as noted above, the curl C may result from causes other than adherence to the blanket cylinder. The apparatus of the present invention may be used equally well to remove any such curls.

After the sheet has been imprinted with an inked image, it is delivered to the apparatus of the present invention by a transport mechanism, generally idicated at 20, which comprises an endless conveyor 22 reeved about a guide and a drive roll, 26 and 28 respectively, which continuously move it in the direction indicated by arrows A. A series of complementary grippers 24 are mounted on the conveyor at spaced locations along its extent to receive the leading edge of each sheet delivered by the impression cylinder grippers 16, and ultimately to drop the sheet on a collection tray 25 where a stack of decurled sheets is assembled.

Conveyor 22 and grippers 24 operate to draw each curled sheet across the apparatus of the present invention which includes a trough member, generally indicated at 30, that is connected to a vacuum pump 32. The trough member 30, illustrated in greater detail in FIGS. 2 through 4, is slightly wider than the maximum width sheet that can be handled by the press and includes two laterally extending, elongate, sheet supporting members 34 and 36, which have surfaces that are arcuate in cross-section. An elongate fillet 38, having an arcuate surface curved in the direction opposite to that of the supporting member surfaces, joins the supporting members. It is preferable that supporting members 34 and 36 and fillet 38 be formed from a single piece of metal such as stainless steel which exhibits excellent wear characteristics. As shown in FIG. 4, a bottom plate 40 is mounted below the supporting members and fillet and is sealed at the extreme opposing edges 42 and 44 of the surfaces, for example, by crimping to define two manifolds 46 and 48.

A large hole 50 is disposed through bottom plate 40 and communicates with both manifolds 46 and 48. A coupling 52 extends downwardly from the hole 50 and serves as a convenient means for attachment of a vacuum hose 54 which leads to the vacuum pump 32.

A series of vacuum conduits 56 are drilled in pairs through the fillet at its bottom. That is, the conduits are positioned on opposite sides of the fillet centerline. Accordingly, when the vacuum pump 32 is operated, air flow is effected through the vacuum hose 54, the manifolds 46 and 48 and the vacuum conduits 56. A sheet pulled across the top of trough member 30 by the conveyor 22 is drawn down onto the sheet supporting surfaces and into the fillet. As shown in FIG. 1, this operation imparts a bend which is reversed with respect to the natural curl C of the sheet.

L-shaped mounting brackets 58 are secured to both ends of the trough member 30 by suitable means such as welding and are mounted by bolts 62 on complementary main support L-shaped brackets 60, which are secured to the frame F of printing press 10. This mounting bracket assembly may provide for relative adjustment of the trough member and the press frame, permitting the trough member to be placed perpendicular or at an angle to the direction of travel of the sheet material to be decurled.

It has been found that various dimensional characteristics of the trough member and vacuum conduits are important to proper decurling without imparting an additional primary or secondary reverse curl to the sheet material. Further, those dimensional characteristics are important to efficient operation of the apparatus over a broad range of conditions including a broad range of sheet widths.

The dimensional characteristics of the trough member may be calculated as follows. Plastic or elastic behavior of sheet material, both paper and metal foil, is determined by the amount of strain to which the material is subjected during deformation. Both steel and paper exhibit elastic characteristics for strains of approximately 0.2% or less. However, both materials exhibit plastic characteristics for strains of approximately 0.5% or greater. Further, if deformation results from bending the material, the strain is related to both the radius of the bend and the thickness of the material.

Thus, if:

$t$ = thickness of the sheet material being bent;

$R$ = radius of the bend;

$L$ = unstressed length of the sheet material;

$\Delta L$ = change in length of the sheet material due to application of stress;

$\theta$ = angle through which the sheet material is bent;

$\epsilon$ = strain

Then:

$$L = 2\theta \left(R + \frac{t}{2}\right) \quad (1)$$

$$\Delta L + L = 2\theta (R + t) \text{ TM } (2) \text{ PS}$$

Strain $\epsilon$ may be rewritten as:

$$\epsilon = \left(\frac{\Delta L + L}{L} - 1\right) \quad (3)$$

Substituting equations (1) and (2) into equation (3) yields:

$$\epsilon = \frac{2 + 2\left(\frac{R}{t}\right)}{1 + 2\left(\frac{R}{t}\right)} - 1 \quad (4)$$

Using equation (4), it can be shown that deformation of sheet material through a bend radius of 250*t* produces a natural strain of 0.2% . Similarly, deformation through a bend radius of 100*t* produces a natural strain of 0.5% .

This information is used to design the supporting members 34 and 36 whose arcuate surfaces should not plastically deform the sheet material passing over them, that is, should not impart additional primary curl to the sheet material. Thus, as shown in FIG. 4, if supporting member surfaces are designed to handle sheet material having thickness *t*, their radius R is preferably greater than 250*t* and should in no case be less than 100*t*.

Further, it has been found that effective decurling results when the sheet material is bent through a reverse curve having radius between one and two times the radius of a curve which would produce a primary curl equal to that sought to be removed. The most severe curls produced by typical printing presses such as those described above are equivalent to those resulting from bending the sheet material through curve having radius equal to 15*t*. Using this information, the apparatus of the present invention is designed so that the fillet radius a is 15*t* or less. This design feature permits decurling of sheets having less than what is ordinarily the most severe curl by reducing air flow created by the vacuum source so that the sheet is not pulled tightly into the fillet. Accordingly, such sheets are bent through curves having radius greater than 15*t*.

Versatility of the apparatus in handling sheets having varying curls is enhanced by making the angle $\alpha$ enclosed by the fillet, i.e. the angle defined by the planes tangent to the supporting member arcuate surfaces at the lines of transition into the fillet surface, between 60° and 120° and preferably between 60°and 90°.

In order to achieve efficient, effective operation of the apparatus of the present invention, it is necessary that the flow of air through the vacuum conduits be sufficient to pull curled sheet material down onto the top of the trough member when transported thereacross by the conveyor 22. Once pulled down, the pressure differential created by the vacuum should be great enough to tightly pull the paper into the fillet surface if necessary. As noted above the vacuum source should also be adjustable so that different degrees curl can be removed by not pulling the sheet material as tightly into the fillet surface. The apparatus should be capable of achieving these objectives for paper widths as narrow as one-half the maximum width for which the trough is designed. Such performance is provided by the apparatus of the present invention in the following way.

It has been found that for sheet widths as narrow as one-half the maximum width for which the trough is designed, the cross-sectional area of the vacuum conduits 56 has a large effect on the air flow needed to pull paper down to the trough member but has little effect on the vacuum needed to decurl the material. Generally, the maximum decurling vacuum needed to pull typical paper stock (having a thickness of 0.004 inches) tightly onto the fillet surface is three inches of mercury. However, the vacuum required to pull the paper down to the trough member varies as a function of the cross-sectional area of the vacuum conduits. FIG. 5 illustrates the vacuum in inches of mercury (in. Hg) and the air flow in cubic feet per minute per linear foot of the trough member (cfm/ ft) required to pull down a full width sheet for four different values of the cross-sectional area of the vacuum conduits per linear foot of trough member (in.$^2$/ft.). That is, pull down and decurling requirements in terms of both vacuum and flow are illustrated for each of four vacuum conduit cross-sectional areas. Further, each curve illustrates the flow as a function of vacuum between pull down and decurling for each conduit area. Flow varies linearly as the inverse of vacuum, for each value of conduit area, between the quantities of each required for pull down and decurling. This means that after the sheet has been pulled to the trough member, vacuum increases linearly and flow decreases linearly as the sheet is further pulled tightly into the fillet for decurling. Further, as expected, the vacuum reaches a maximum when air flow reaches a minimum for all vacuum conduit sizes, all flow being essentially stopped since all conduits are covered.

The data, graphically illustrated in FIG. 5, is as follows:

TABLE 1

| Vacuum Conduit Area (in$^2$/ft) | 0.036 | 0.07 | 0.14 | 0.21 |
|---|---|---|---|---|
| Vacuum (in. Hg) Needed for Sheet Pull Down for Each Conduit Area | 0.6 | 0.15 | 0.1 | 0.05 |
| Flow (cfm/ft) Needed for Sheet Pull Down for Each Conduit Area | 1.88 | 1.87 | 3.05 | 3.3 |

As can be seen, most efficient operation results when the vacuum conduit cross-sectional area is 0.07 in$^2$/ft., since the required flow generating capacity of the vacuum pump is minimum. Operation of apparatus having a trough member with both larger and smaller vacuum conduit cross-sectional areas requires that the vacuum source be capable of larger flow capacities. Accordingly, pull down is effectively accomplished with minimum vacuum pump flow capacity requirements with conduits having area of 0.07 in$^2$/ft. Thus, further efficiencies are not thought to be achieved with conduit areas substantially different than 0.07 in$^2$/ft. Accordingly, conduit area of from 0.05 in$^2$/ft. are thought to be appropriate. In some applications, for example where only full width sheets are to be run, the conduit area may be somewhat greater than 0.07 in$^2$/ft. of trough.

Figure 6:
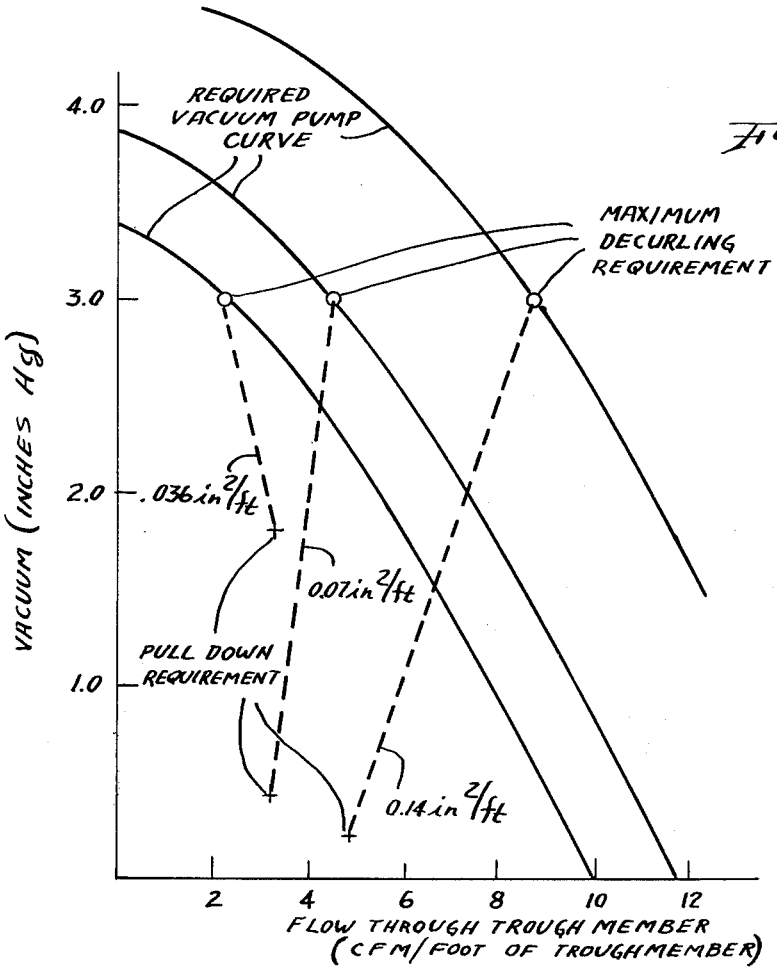
FIG. 6 is a similar graph of vacuum versus air flow through the trough member, illustrating pull down and decurler requirements for sheets having width half as great as the trough member is capable of accommodating.

The vacuum and decurling requirements for both pull down and decurling, for various vacuum conduit areas, have also been determined for sheet material having width one-half as large as the trough member is capable of accommodating. These requirements are calculated without covering any conduits exposed at the edges of the sheet. FIG. 6 illustrates the pull down and decurling requirements of a half width sheet again in terms of vacuum generated in inches Hg and air flow through the trough member in cfm/ft for three vacuum conduit areas. That is, pull down and decurling requirements in terms of both vacuum and flow are again illustrated but for only three vacuum conduit cross-sectional areas. Each curve illustrates the flow as a function of vacumm for each of three vacuum pumps needed to decurl sheets on trough members having the respective conduit areas. In this case, flow does not vary linearly but still varies as the inverse of vacuum, for each value of conduit area, between the quantities of each required for pull down and decurling. This means that after the sheet has been pulled to the trough member, vacuum increases and flow decreases as the sheet is further pulled tightly into the fillet for decurling. However, flow does not stop in this case when the half-width sheet is pulled tightly into the fillet because conduits remain exposed.

The data illustrated in FIG. 6 is as follows:

TABLE 2

| Vacuum Conduit Area ($in^2/ft$) | 0.036 | 0.07 | 0.14 |
|---|---|---|---|
| Vacuum (in Hg) Needed for Sheet Pull Down at Each Conduit Area | 1.8 | 0.45 | 0.25 |
| Flow (cfm/ft) Needed for Sheet Pull Down at Each Conduit Area | 3.32 | 3.25 | 4.83 |
| Vacuum (in Hg) Needed for Decurling at Each Conduit Area | 3.0 | 3.0 | 3.0 |
| Flow (cfm/ft) Needed for Decurling at Each Conduit Area | 2.19 | 4.38 | 8.76 |

It can be seen that a vacuum conduit area of 0.07 $in^2/ft.$ again yields the best results. Trough members having larger area vacuum conduits require that a vacuum pump having increased capacity be used because more air flow is required to pull the sheet down. More importantly, however, trough members having smaller area vacuum conduits severely limit the minimum decurling vacuum which can be run by, for example, reducing source speed. The adjustability of the vacuum pump used with such smaller conduits is limited since decurling and pull down vacuum requirements are more nearly the same than those for larger conduits. Thus, when the sheet is pulled down it is almost immediately further pulled tightly into the fillet. This factor makes the conduit area 0.07 $in^2/ft.$ more desirable even though the smaller conduits require less flow to accomplish decurling.

Accordingly, the relatively low capacity vacuum pump may be used to effectively decurl sheets on a trough constructed as described above. Further, exposed conduits need not be covered to efectively decurl sheets having widths less than the apparatus'-capacity.

It is believed that the beneficial results described above can be achieved by trough members having vacuum conduits with areas in the range from 0.05 $in^2/ft.$ to 0.15 $in^2/ft.$ An operational embodiment has utilized 1/16 inch diameter vacuum conduit pairs spaced on one inch centers with excellent results.

A trough designed as described above can preferably be matched with a vacuum source in the form of a peripheral blower pump driven by a 1700 rpm variable speed ¾horsepower motor. Such a pump has sufficient capacity to operate with a variety of trough widths and to satisfactorily decurl sheets ranging from full to one-half trough member width.

It has been found that the vacuum pump should be reversible so that the system can be backflushed of particles, such as cornstarch powder used to separate sheets, which collect in the decurler system. Further, reversibility of the vacuum pump provides an air cushion above the trough member to prevent sheet contact therewith if decurling is unnecessary. Pump reversibility is particularly useful to prevent contact of printed matter on the underside of the sheet with the trough.

Further, in addition to the advantages of the present invention described above, the decurler of the invention has a low profile, i.e. the trough member has a small height when compared with prior art devices. Therefore, it can be easily installed in most existing printing presses.

Although a specific embodiment of the present invention has been disclosed above in detail, it is to be understood that this is for purposes of illustration. Modifications may be made to the described apparatus for decurling sheet material by those skilled in the art in orderr to adapt this apparatus to particular applications.

What is claimed is:

1. A sheet material decurling apparatus for use with a machine having sheet material conveyor means, the sheet material having thickness *t;* said apparatus comprising:

A. a trough member including 1. two elongate sheet supporting members, each having an arcuate upper surface with a radius greater than 100*t*,
2. an elongate fillet joining said sheet supporting members having an arcuate upper surface, curved in the direction opposite to that of the sheet supporting member surfaces, with a radius of less than 15*t*, the angle formed between the planes tangent to said sheet supporting member surfaces at the lines of transition therefrom into the fillet surface being in the range of 60° to 120°, and
3. a plurality of vacuum conduits adjacent the bottom of said fillet, said conduits having a cross-sectional area of from 0.05 square inch to 0.15 square inch per linear foot of trough member, and B. a vacuum pump in fluid communication with said vacuum conduits for generating gas flow downward therethrough, whereby sheet material drawn across said trough member, with a curl directed theretoward by the conveypr means, is pulled down onto said sheet supporting member surfaces and into said fillet by gas flow generated by said vacuum pump to impart a reverse bend to the sheet material and whereby said decurling apparatus can decurl sheet material having widths less than that which the trough member can accommodate without covering exposed vacuum conduits.

2. The sheet material decurling apparatus as claimed in claim 1 wherein said vacuum conduits have a cross-sectional area of approximately 0.07 square inch per linear foot of trough member.

3. The sheet material decurling apparatus as claimed in claim 1 wherein said vacuum conduits are positioned on opposite sides of the centerline of said fillet adjacent the bottom thereof.

4. The sheet material decurling apparatus as claimed in claim 1 wherein the radius of said sheet supporting member surfaces is greater than 250*t*.

5. The sheet material decurling apparatus as claimed in claim 1 wherein the angle formed between the planes tangent to said sheet supporting member surfaces at the lines of transition therefrom into the fillet surface is in the range of 60° to 90°.

6. A sheet material decurling apparatus for use with a machine having sheet material conveyor means, said sheet material having thickness *t*; said apparatus comprising:

A. a trough member including
   1. two elongate sheet supporting members, each having an arcuate upper surface with a radius greater than 250*t*,
   2. an elongate fillet joining said sheet supporting members and having an arcuate upper surface, curved in the direction opposite to the sheet supporting member surfaces, with a radius less than 15*t*, the angle formed between the planes tangent to said sheet supporting member surfaces at the lines of transition therefrom into the fillet arcuate surface being in the range of 60° to 90°, and
   3. vacuum conduit means adjacent the bottom of said fillet said conduit means having an open cross-sectional area of from 0.05 square inch to 0.15 square inch per linear foot of trough member, and B. a vacuum pump means for generating gas flow downward through said vacuum conduits, whereby sheet material drawn across said trough member with the curl directed theretoward by said conveyor means is pulled down onto said sheet supporting member surfaces and into said fillet by air flow generated by said vacuum pump means to impart a reverse bend to the sheet material.

7. The sheet material decurling apparatus as claimed in claim 6 wherein said vacuum pump is reversible to provide gas flow up through said vacuum conduits.

8. The sheet material decurling apparatus defined in claim 6 wherein said vacuum conduit means comprises a plurality of separate vacuum conduits.

9. The sheet material decurling apparatus defined in claim 6 wherein the cross-sectional open area of said vacuum conduit means is about 0.07 square inch per foot of trough member.

10. A sheet material decurling apparatus for use with a machine having sheet material conveyor means, said sheet material having thickness t; said apparatus comprising:

A. a trough having
   1. a pair of parallel elongate sheet supporting members, each of
      a. said members having an arcuate convex upper surface with a radius greater than 250*t* to form sheet supporting surfaces on top, and
      b. said members being closed on their ends and underside to form a manifold,
   2. a fillet joining said sheet supporting members,
      a. said fillet having a concave upper surface with a radius of less than 15*t*, and
   3. vacuum conduit means adjacent the bottom of said fillet and communicating with said manifold,
      a. said conduit means having an open crosssectional area of about 0.07 in.$^2$ per linear foot of trough member, and B. a vacuum pump connected to said manifold to draw air downwardly through said vacuum conduit means in a first mode,
   1. said vacuum pump being reversible to selectively blow air upwardly through said vacuum conduit means, in a second mode, whereby sheet material being moved over said fillet for sheet decurling when said vacuum pump is in said first mode and in said second mode said vacuum pump purges the apparatus and maintains sheet material away from the surfaces of said trough member.

11. The sheet material decurling apparatus as claimed in claim 10 wherein said vacuum conduit means comprises a plurality of spaced holes on opposite sides of and adjacent the bottom of said fillet.

* * * * *

UNITED STATES PATENT OFFICE

CERTIFICATE OF CORRECTION

Patent No. 4,002,047 Dated January 11, 1977

Inventor(s) JOHN M. MACPHEE and CHARLES ROBERT GASPARRINI

It is certified that error appears in the above-identified patent and that said Letters Patent are hereby corrected as shown below:

Column 4, line 64, the equation "$L = 2\theta\ (R + \frac{t}{2})$" should read --$L = \theta\ (R + \frac{t}{2})$--;

Column 4, line 67, the equation "$\Delta L+L = 2\theta\ (R + t)$ TM (2) PS" should read --$\Delta L+L = \theta\ (R + t)$ (2)--.

Column 7, line 8, "vacumm" should read --vacuum--;
Column 7, line 55, "efectively" should read --effectively--;
Column 7, line 56, "apparatus'-" should read --apparatus'--.
Column 8, line 23, "orderr" should read --order--;
Column 8, line 53, "conveypr" should read --conveyor--.

Signed and Sealed this

Third Day of May 1977

[SEAL]

*Attest:*

RUTH C. MASON
*Attesting Officer*

C. MARSHALL DANN
*Commissioner of Patents and Trademarks*